United States Patent [19]

Wiklund

[11] Patent Number: 4,720,956

[45] Date of Patent: Jan. 26, 1988

[54] PLATE PROFILE

[76] Inventor: Per Wiklund, 58 A Kungsgatan, S-961 36 Boden, Sweden

[21] Appl. No.: 924,840

[22] PCT Filed: Jan. 24, 1986

[86] PCT No.: PCT/SE86/00026

§ 371 Date: Sep. 17, 1986

§ 102(e) Date: Sep. 17, 1986

[87] PCT Pub. No.: WO86/04373

PCT Pub. Date: Jul. 31, 1986

[30] Foreign Application Priority Data

Jan. 25, 1985 [SE] Sweden ..... 8500361
Apr. 10, 1985 [SE] Sweden ..... 8501763

[51] Int. Cl.[4] ..... E04C 2/08; E04B 1/40; E04D 3/30

[52] U.S. Cl. ..... 52/648; 52/90; 52/720

[58] Field of Search ..... 52/732, 90, 94, 720, 52/690, 691, 692, 693, 694, 39, 648, 654

[56] References Cited

U.S. PATENT DOCUMENTS 1,611,715 12/1926 Bonsall ..... 52/720
1,886,478 10/1932 Ragsdale ..... 52/694
1,909,930 5/1933 De Ridder ..... 52/720
3,427,767 2/1969 Schaefer ..... 52/90
3,656,270 4/1972 Phillips ..... 52/732
4,620,397 11/1986 Simpson ..... 52/90

*Primary Examiner*—John E. Murtagh
*Attorney, Agent, or Firm*—Cushman, Darby & Cushman

[57] ABSTRACT

The invention relates to a plate profile (1) intended to be fitted to an anchoring profile (8) connected with a support and to carry another plate profile (5) in the region of its upper end. The plate profile (1) has an upright central portion (2) with an upwardly decreasing width. Two lateral portions (3) which extend transversely to the central portion (2) start from the central portion (2). The lateral portions (3) extend vertically between the anchoring profile (8) and the further plate profile (5). The plate profile (1) is provided with means (12) for engagement with the anchoring profile (8). In the region of their upper end the lateral portions (3) are connected with the further plate profile (5) by way of attaching means (7). The width of the lateral portions (5) increases upwards.

The plate profile (1) is included as an essential component of a structure replacing known frames of crossbars for supporting roofs of buildings.

The plate profile (1) of the invention is characterized in that it stays up the further profile (5) which is supports in two directions perpendicular to each other.

6 Claims, 2 Drawing Figures

PLATE PROFILE

This invention relates to a plate intended to be fitted to an anchoring profile connected with a support and to carry another plate profile in the region of its upper end.

Constructions of roofs with a slight fall, usually at multifamily houses, are frequently made both in new construction and reconstruction works. A frame of crossbars resting on joists or the like is then erected. A protection against condensation, e.g. in the form of fibre boards, is thereafter placed on the upper side of the frame of crossbars. The outer roof covering is then laid on top of said condensation protection. Said frame of crossbars must be stayed in different directions in order to absorb the appearing loads, e.g. snow and wind.

It is the object of this invention to provide a plate profile of the kind indicated above which is included as an essential component of a construction replacing the above-mentioned frame of crossbars known. The plate profile of the invention provides staying in two directions perpendicular to each other of the further plate profile supported in the region of its upper end. The further plate profile supports the protection against condensation and the outer roof covering. According to a preferred embodiment of the invention it is started from a rectangular sheet billet in manufacture of the profile of the invention.

A further object of this invention is to provide anchoring of the plate profile to the underlying anchoring profile. Said anchoring is extraordinarily simple and quick simultaneously as the adjusting possibilities of the position of the plate profile relative to the anchoring profile are good afterwards.

The objects of the invention are realized by means of a plate profile which has been given the characteristic features defined in the following claims.

Figure 1:
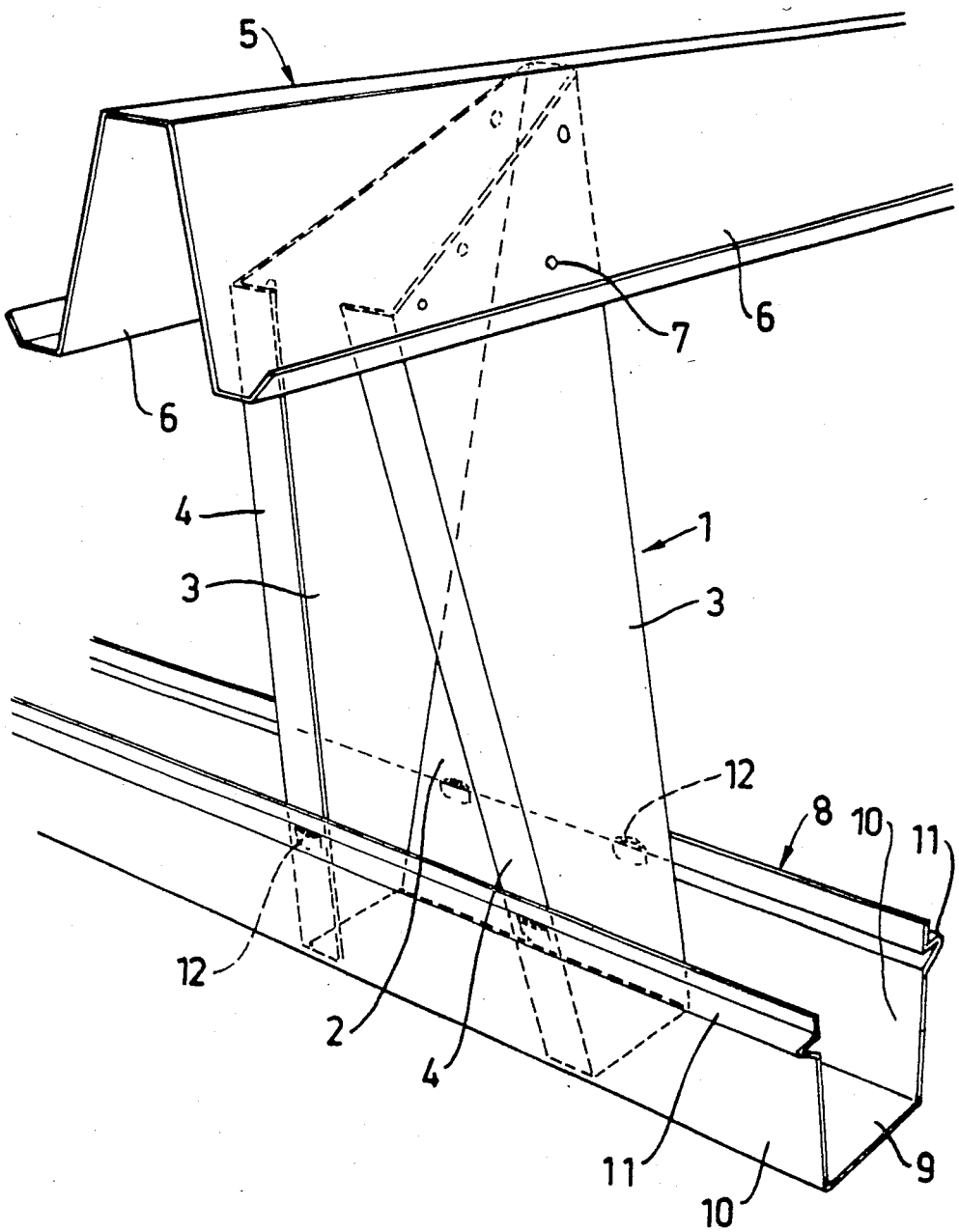
Figure 2:
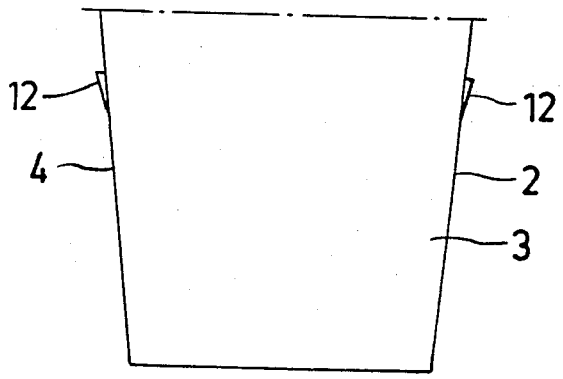

An illustrated example of the invention will be described below with reference to the enclosed drawings, in which FIG. 1 is a perspective view of an embodiment of a plate profile of the invention, and FIG. 2 is a section of a lateral view of a plate profile according to the invention.

The plate profile 1 shown in FIG. 1 comprises a central portion 2 having the basic shape of a trapezoid with upwardly decreasing width. Two lateral portions 3 which narrow off downwards are connected to the lateral edges of the central portion 2. The lateral portions 3 have stiffening members 4 folded at right angles at their edges turned from the central portion 2. In the region of their upper ends the lateral portions 3 bear against the inside of the web 6 of a hat profile 5 and are connected with these by way of attaching means 7 which for instance can be plate skrews or rivets.

The upper limiting edge of the central portion 2 is of such a length that it fits to bear against the upper flange of the hat profile 2.

As the plate profile 1 according to FIG. 1 is made of a rectangular billet the height of the lateral portions 3 will decrease in a direction away from the central portion 2.

As is apparent from FIG. 1 the plate profile 1 is received in the lower end of the figure in a U-shaped anchoring profile 8 comprising a bottom 9 and two side walls 10. A longitudinal folding 11 which is directed outwards in respect of the center of the anchoring profile 8 is arranged in the region of the free ends of the side walls 10.

Tongues 12 or the like, see also FIG. 2, are punched in the region of the lower part of the plate profile 1.

As is apparent from FIG. 2 the tongues 12 are made so that they have an upwardly directed free edge cooperating with the folding 11, see FIG. 1, in order to anchor the profile 1 in the anchoring profile 8.

By the special embodiment of the plate profile 1 it will absorb forces in two directions perpendicular to each other, forces in the longitudinal direction of the plate profile 5 substantially being absorbed by way of the trapezoidal lateral portions 3 which bring down said forces to the anchoring profile 8 while forces transversely to the longitudinal direction of the hat profile 5 are substantially absorbed by the central portion 2 which brings down these forces to the anchoring profile 8. Thus, the plate profile 1 of the invention will stay the further plate profile 5 in two directions perpendicular to each other.

The system described above is assembled as follows. The U-shaped anchoring profile 8 is fastened to its support which for instance can consist of a concrete arch. This can be done in that the anchoring profile 8 is fastened by shooting, so-called concrete nails being used. When the anchoring profile 8 is positioned the plate profile 8 is adapted to the anchoring profile 8 in such a way that the narrower ends of the lateral portions 3 are pressed down into the anchoring profile 8 from above. The side walls 10 will then spring outwards and the tongues 12 will be in contact with the free edges of said side walls 10. On continued downward displacement of the plate profile 1 the tongues 12 will snap into the foldings 11, the upper free edges of the tongues 12 forming a lock against the upper limiting edge of the foldings 11. When this has been done the plate profile is thus locked relative to the anchoring profile 8 as far as vertical displacement is concerned. However, the plate profile 1 can be displaced in the longitudinal direction of the anchoring profile 8 which is a great advantage when the final adjustment of the mutual distance of the plate profile 1 is to be made. If desired, a number of screws or rivets penetrating a side wall 10 and the central portion 2 or a stiffening portion 4 can be adapted after reaching the final position of the plate profile 1 in the anchoring profile 8. However, this can preferably be done after mounting the hat profile 5 on the plate profile 1 at its upper end.

Thus, the plate profile 1 of the invention provides staying in two directions in respect of the hat profile 5 which is realized directly considering FIG. 1.

The described embodiment of the plate profile of the invention is only exemplifying. It is immediately realized that there is room for a great number of variants within the scope of the inventive idea, viz., to provide a profile staying in two directions perpendicular to each other. Thus, the invention can be freely varied within the scope of the appended claims.

I claim:

1. A plate profile intended to be fitted to an anchoring profile connected with a suport and to carry another plate profile in the region of its upper end, wherein the plate profile has an upright central portion with an upwardly decreasing width, that two lateral portions extending transversely to the central portion start from said central portion, the lateral portions extending vertically between the anchoring profile and the further plate profile, that the plate profile has means for engagement with the anchoring profile, wherein the means for engagement with the anchoring profile comprises tongues and the anchoring profile has folds arranged in its longitudinal direction and cooperating with the tongues, and the lateral portions are connected with the further plate profile by way of attaching means in the region of their upper end, the lateral portions having an upwardly increasing width.

2. The plate profile of claim 1, wherein the further plate profile has a web and the lateral portions bear upon the web of the further plate profile.

3. The plate profile of claim 1 or 2, characterized in that the further plate profile comprises a hat profile (5).

4. The plate profile of claim 1 wherein the lateral portions have a stiffening member folded at their edge turned from the central portion.

5. The plate profile of claim 1, wherein the lateral portions extend in the same direction in respect of the central portion.

6. The plate profile of any one of claims 1–5, wherein the anchoring profile is U-shaped and that one end of the plate profile fits substantially to the anchoring profile by its form.

* * * * *